US008764545B2

(12) United States Patent
Naicker et al.

(10) Patent No.: US 8,764,545 B2
(45) Date of Patent: Jul. 1, 2014

(54) MULTI-LEVEL WAGER GAMES WITH AUTOCOMPLETE

(75) Inventors: Theo Naicker, Durban (ZA); Francesco Verardi, Isle of Man (GB)

(73) Assignee: Cork Group Trading Ltd., Tortola (VG)

( * ) Notice: Subject to any disclaimer, the term of this patent is extended or adjusted under 35 U.S.C. 154(b) by 1180 days.

(21) Appl. No.: 11/253,089

(22) Filed: Oct. 17, 2005

(65) Prior Publication Data

US 2009/0149243 A1 Jun. 11, 2009

(51) Int. Cl.
*A63F 9/24* (2006.01)
*G07F 17/32* (2006.01)

(52) U.S. Cl.
CPC ..... *G07F 17/32* (2013.01); *G07F 17/3293* (2013.01)
USPC ..... 463/20; 463/25; 463/29; 463/42

(58) Field of Classification Search
USPC ..... 273/274; 463/16–20, 42, 25, 29
See application file for complete search history.

(56) References Cited

U.S. PATENT DOCUMENTS

| | | | | |
|---|---|---|---|---|
| 4,861,041 | A | 8/1989 | Jones et al. | 273/292 |
| 4,948,134 | A | 8/1990 | Suttle et al. | 463/13 |
| 5,078,405 | A | 1/1992 | Jones et al. | 463/27 |
| 5,288,077 | A | 2/1994 | Jones | 273/292 |
| 5,364,104 | A | 11/1994 | Jones et al. | 273/292 |
| 5,377,973 | A | 1/1995 | Jones et al. | 463/12 |
| 5,626,341 | A | 5/1997 | Jones et al. | 273/292 |
| 6,089,976 | A | 7/2000 | Schneider et al. | 463/16 |
| 6,474,645 | B2 * | 11/2002 | Tarantino | 273/274 |
| 6,612,927 | B1 | 9/2003 | Slomiany et al. | 463/16 |

(Continued)

FOREIGN PATENT DOCUMENTS

| | | |
|---|---|---|
| EP | 1319428 | 6/2003 |
| EP | 1383095 | 1/2004 |

(Continued)

OTHER PUBLICATIONS

European Search Report in Application No. EP 06 25 5331.0, dated Jan. 8, 2007.

(Continued)

*Primary Examiner* — Steve Rowland
(74) *Attorney, Agent, or Firm* — McDonnell Boehnen Hulbert & Berghoff LLP

(57) ABSTRACT

Multi-level wager games are described in which play at higher levels in the game continues even if the player does not achieve a winning result for play at a given level. Such play at the higher levels may be completed automatically in an autocomplete mode, without any additional player interaction. A payout is awarded if the outcome of play at any of the higher levels is a winning result in accordance with a special pay table designed for such autocomplete mode. In one embodiment, the special pay table is constructed such that the odds of obtaining a winning result in the autocomplete mode are less than the odds of obtaining a winning result for play at the first level. For example, in a two level poker game, if the player loses in the first level with only a pair of sixes (pair of Jacks or better needed for a winning hand in the first level), the cards in the second hand are revealed and the player obtains a winning result for second level hand only if the hand is dealt a Royal Flush.

20 Claims, 11 Drawing Sheets

(56) References Cited

U.S. PATENT DOCUMENTS

| | | | | |
|---|---|---|---|---|
| 6,638,163 | B2 | 10/2003 | Moody | 463/13 |
| 6,793,575 | B2 | 9/2004 | Brown et al. | 463/6 |
| 6,926,607 | B2 | 8/2005 | Slomiany et al. | 463/20 |
| 2002/0115485 | A1 | 8/2002 | Muir et al. | 463/20 |
| 2003/0064784 | A1* | 4/2003 | Wells et al. | 463/20 |
| 2003/0114217 | A1* | 6/2003 | Walker et al. | 463/20 |
| 2003/0207707 | A1* | 11/2003 | Slomiany et al. | 463/16 |
| 2004/0166922 | A1 | 8/2004 | Michaelson et al. | 463/20 |
| 2004/0198481 | A1* | 10/2004 | Herrington et al. | 463/13 |
| 2005/0020340 | A1* | 1/2005 | Cannon | 463/16 |
| 2005/0096121 | A1* | 5/2005 | Gilliland et al. | 463/20 |
| 2005/0215301 | A1* | 9/2005 | Seelig et al. | 463/16 |

FOREIGN PATENT DOCUMENTS

| | | |
|---|---|---|
| WO | WO 0126019 | 4/2001 |
| WO | WO 0232523 | 4/2002 |
| WO | WO 03093921 | 11/2003 |

OTHER PUBLICATIONS

Examination Report in AU 2006203331 dated Mar. 28, 2008.

* cited by examiner

MULTI-LEVEL WAGER GAMES WITH AUTOCOMPLETE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This disclosure relates generally to wager games such as poker, slots and dice games, and more particularly to wager games that are capable of being played at multiple levels or rounds. Such games typically provide for progressively larger payouts at each successive level if the player continues to achieve a winning result and advances to the next level.

Multi-level wager games are known in the art and described in the patent literature, including U.S. Pat. No. 6,612,927 (Slomiany et al.) and U.S. Pat. No. 6,648,163 (Moody). In one version of a multi-level poker game, a first round of poker, such as five card draw poker, is played at a first level. If the player does not obtain the minimum poker hand ranking in the first level or round, the game is over and the player does not advance to a second level or round. However, if the player obtains a hand with a minimum poker hand ranking, such as a pair of Jacks or better, a winning result is deemed to have been achieved and the player wins according to a pay table. The player then advances to play at a second level of the game. The attraction of this game, referred to sometimes as "multi-level poker" or "multi-strike poker", is that the pay table for the second round is typically higher than the pay table for the first round. For example, the pay table for the second round might be double the pay table for the first round. Stated differently, if the player has a winning hand at the second level they would win twice as much at the second round as they would in the first round for the same poker hand.

As a method of adding additional excitement to the game, the game can be extended to additional levels, such as a third level and a fourth level, with the player only advancing to the next level if they continue to achieve a winning hand (i.e., a poker hand with a minimum poker hand ranking). However, the pay table for the third and subsequent rounds continues to escalate, e.g., at each successive level the pay table doubles again. A lucky player that wins at each level up to and including the fourth level has a potential for an enormous payout, particularly if they have a good or great hand at the highest level. The risk the player faces is that if the player loses at any level, the game is over, they forfeit their wager on the levels that they did not get to play, and they only retain their winnings for the level(s) at which they had the minimum poker hand ranking, if any, less their initial wager.

The concept of poker played at multiple levels, as described above, can be extended to other card wager games, and to other non-card wager games, such as slots or dice games such as Bunco, as set forth in the aforementioned '927 U.S. patent. Such games can be played in a variety of formats, such as using video gaming terminals, at a card table, or in an on-line gaming format where a player plays at a computer workstation and communicates with a gaming server associated with a casino website over a network such as the Internet.

There is an ongoing need in the art for providing new and exciting games for players, including new and exciting improvements to multi-level wager games. This invention provides for an improved method and apparatus for playing multi-level wager games, and is applicable to dice, poker, slots, and other types of games capable of being played in a multi-level format.

SUMMARY

The following embodiments and aspects thereof are described and illustrated in conjunction with systems, tools and methods which are meant to be exemplary and illustrative, not limiting in scope.

In a first aspect, a method is provided for facilitating playing a wager game having a plurality of levels of play including at least a first level and a second level using a gaming device. The gaming device may take the form of a video terminal, portable computing device, or computer workstation. The method comprises a step of determining the outcome of play at the first level, the first level having an outcome that is either a winning result or is not a winning result. For example, the play at the first level may be a dealing of a poker hand, and the determining the outcome of play amounts to determining whether the poker hand dealt to the player (either with or without a draw step) has a minimum poker hand ranking. As another example, the play may consist of a turn of a slot machine and the determination of the outcome is a determination of whether the reels of the slot machine have a winning combination of symbols.

In the event that the play at the first level is not a winning result, rather than simply ending the game, as in the prior art for multi-level games, in the present invention the game is not over. Rather, the play continues. In particular, the method continues with the steps of (a) determining the result of play at the second level, the play at the second level having an outcome that is either a winning result or is not a winning result; and (b) providing the gaming device with data for displaying of the outcome of play at the first and the second level. The play at the second level may for example consist of revealing the cards in the hand that was dealt for the second level and determining whether the cards have a certain minimum poker hand ranking. Typically, this minimum poker hand ranking (and associated pay table) is different, and statistically less likely to occur, than the minimum poker hand ranking for the first hand, and may for example be a Royal Flush, Four of a Kind, or some other ranking for which the odds of the second level hand having such a ranking are low. The idea here is that if the player does not have a winning hand at the first level, they still could win at the second level if the second level hand has a Royal Flush, Four of a Kind, or other hand meeting the minimum poker hand ranking for the second level. The gaming device is provided with the data for displaying not only the hand that resulted at the first (losing) level, but also the hand (outcome of play) at the second level so the player can see if they won at the second level in accordance with the pay table for the second hand completed in this manner.

In one illustrated embodiment described below, the play at the second level occurs in an "autocomplete" manner or mode, without any additional user involvement. For example, in a five card draw poker game, the player does not have the opportunity to inspect the hand at the second level, make a selection of cards to hold, and receive replacement cards. Rather, the cards in the second level are turned over and if the cards meet the minimum poker hand ranking for the second level in this "autocomplete" mode, they win in accordance with the second pay table. In an alternative embodiment, the play at the second level could include some additional user involvement, such as for example making a selection of one or more cards to hold in the second hand and then receiving replacement cards.

In other types of games, such as slots, there may be no user involvement in a round of play (other than initiating play initially at the first level). Take for example a slots game with two levels of play. The player plays the first level and does not achieve a winning result. However, the autocomplete mode begins and the reels of the second level spin and a result is displayed. The player nevertheless wins at the second level if the slot reels produce an outcome at the second level that is a winning result in accordance with a second pay table. Suppose the second pay table produces a payout of 1000 to 1 for a result of BAR BAR BAR for a three-reel slot machine game. In this latter example, the player would receive a payout for receiving BAR BAR BAR according to the paytable for the autocomplete mode at the second level. Suppose this was the only winning result in the second pay table under the autocomplete mode. If the player received BAR BAR CHERRY at the second level, the player would not win in the second pay table, even though this was a winning result in accordance with a pay table for play at the first level of play.

The method described above can be extended to games played at three or more levels, such as a five-level game. Consider, as an example, a five-level poker game where a player plays the first level and achieves a hand with a minimum poker hand ranking in accordance with a first pay table (e.g., pair of Jacks), and then advances to the second round, and at the second round the player also achieves a minimum poker hand ranking (pair of Jacks), and wins according to the paytable for play at the second level (e.g., the payout for a par of Jacks per the first paytable multiplied by a factor of 2 since the player won at the second level). Assume in this example that at the third level, the player does not obtain a hand with the minimum poker hand ranking (pair of Jacks). However, at this point, the game is not over. The fourth and fifth hands are revealed to the player, e.g., in an autocomplete manner, and a determination is made if the hands at the fourth or fifth level hands have a winning result in accordance with a second pay table applicable for the auto-complete mode, e.g., a Royal Flush. If either the fourth or fifth level hands contain a Royal Flush, then the player obtains a payout for their wins in the first two levels, plus the payout for a Royal Flush according to a second paytable that is established for the "autocomplete" feature triggered when a player has a losing result at any level of play other than at the highest level. If, on the other hand, the autocomplete of the fourth and fifth levels does not result in a Royal Flush, the player still obtains a payout for their winning hands at the first and second levels, minus their total wager.

In one embodiment, the gaming device comprises a general purpose computer. The facilitation of play as described herein on the general purpose computer may be achieved by generating and sending one or more datagrams to the general purpose computer containing data indicating the outcome of play of the first level and the second level, or if more levels of play are provided, at all of the levels. The generation and sending of the datagrams to the gaming device may be performed by a gaming server, as described in detail below.

In another aspect, a method is described of playing a wager game having a plurality of levels of play including at least a first level and a second level. The method includes a step of determining the outcome of play at the first level, the first level having an outcome that is either a winning result or is not a winning result.

In the event the outcome of play at the first level does not produce a winning result (e.g., (pair of Jacks or better in a poker embodiment), the method further comprises the step of automatically completing play at the second level, the play at the second level having an outcome that is either a winning result or is not a winning result (e.g., a poker hand with a given minimum ranking such as Four of a Kind or Royal Flush).

The method further includes a step of providing a first pay table for determining a winning result for the outcome of play at the first level, and a second pay table for determining the outcome of play that was automatically completed in the event that the play at the first level did not result in a winning result. The statistical probability of the outcome of play producing a winning result in the second pay table is less than the statistical probability of the outcome of play at the first level producing a winning result. In other words, if the player fails to win at the first level and the autocomplete feature is triggered, it is less likely that the player will have a minimum poker hand ranking to win in the autocomplete round because the second pay table only pays out when a relatively unlikely result occurs, such as a Royal Flush. The idea here is that the autocomplete rounds gives at least some small hope to the player for obtaining a winning result in the autocomplete rounds, even though the player lost a round and the autocomplete was triggered. The proprietor of the game can change the odds for winning in the autocomplete rounds by adjusting the second pay table and defining what the minimum outcome must be in order to pay out in accordance with the second pay table.

In a still further aspect, there is provided a machine readable storage medium comprising a set of instructions for execution by a gaming workstation having a display. The gaming workstation is placed in communication with a gaming server over a network, such as a local area or wide area packet switched network. The instructions comprise:

(a) instructions for presenting on the display a wager game having a plurality of levels of play including at least a first level and a second level;

(b) instructions for presenting a first pay table and a second pay table; and (c) instructions for facilitating play by the player at the first level, the gaming server determining an outcome of play at the first level and sending a datagram to the gaming workstation containing such outcome of play, the first level having an outcome that is either a winning result or is not a winning result in accordance with the first pay table. In the event the play at the first level is not a winning result in accordance with the first pay table, the instructions include (d) instructions for automatically completing play at the second level, the play at the second level having an outcome that is either a winning result or is not a winning result in accordance with the second pay table. The first and second pay tables are constructed such that the statistical probability of the outcome of play producing a winning result in the second pay table is less than the statistical probability of the outcome of play producing a winning result in the first pay table.

In a still further aspect, there is provided a central gaming system for facilitating play by a plurality of distributed gaming workstations of a wager game. The wager game provides for play at a plurality of levels including at least a first level and a second level. The central gaming system includes one or more processing units and machine readable storage media comprising a set of instructions, said instructions including instructions for providing the central gaming system to perform the functions of, for each of the distributed gaming workstations:

(a) determining an outcome of the game at the first level, the outcome being either a winning result or not a winning result; and in the event the play at the first level is not a winning result:

(b) generating one or more datagrams containing data comprising (1) the outcome of the game at the first level, and (2) the outcome of the game at the second level, the outcome of the game at the second level having either being a winning result or not a winning result, and (c) transmitting the one or more datagrams to the gaming workstation whereby the workstation may display the outcome of the game at the first level and the second level.

In one embodiment, a winning result of play at the first level and a winning result of play at the second level are determined by reference to a first pay table and a second pay table, respectively, and wherein the statistical probability of the outcome of play producing a winning result in the second pay table is less than the statistical probability of the outcome of play producing a winning result in the first pay table.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION

Overview

Figure 1:
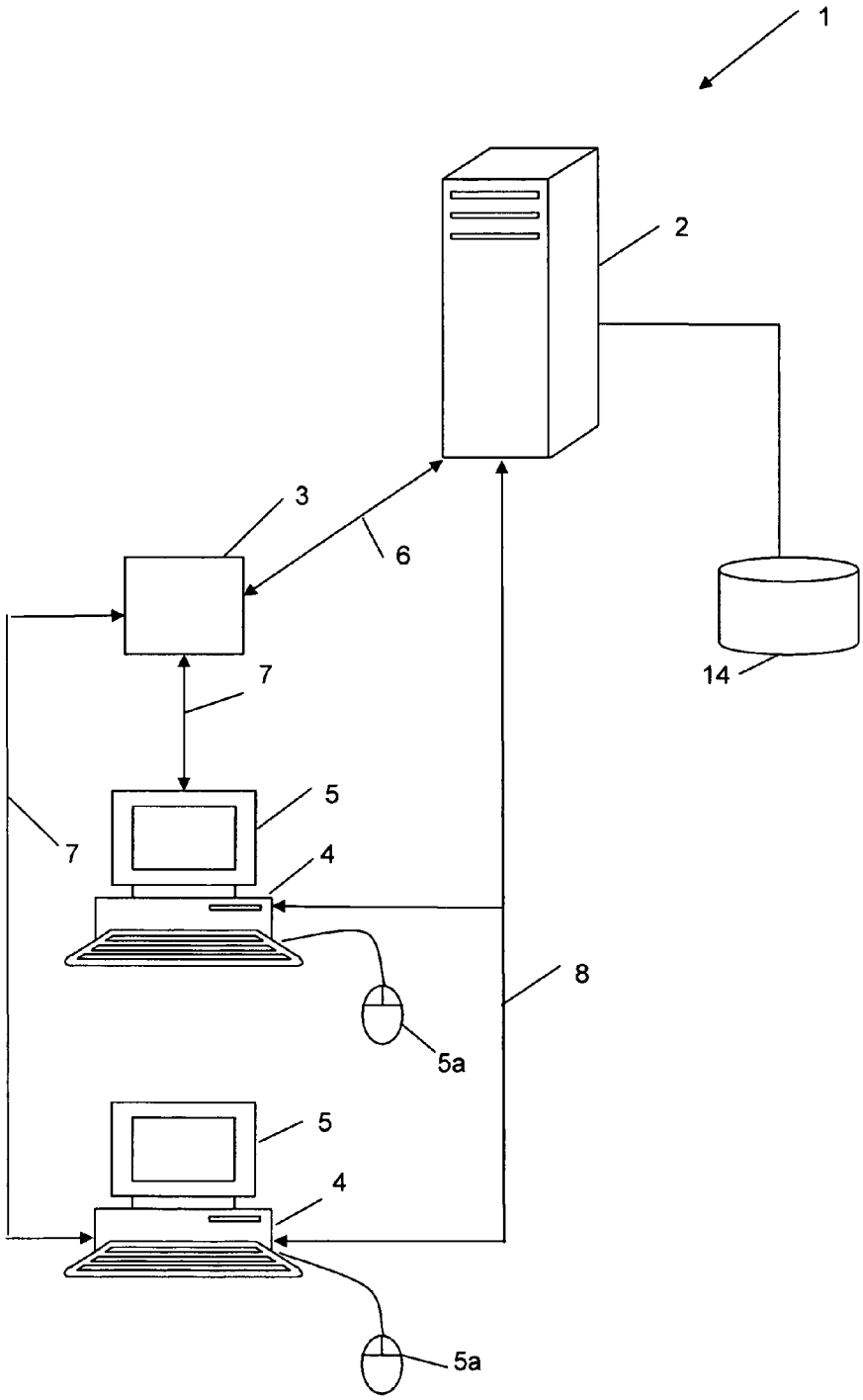
FIG. 1 is a functional diagram of a gaming system in which distributed gaming workstations communicate with a central gaming server.

Methods are described herein for playing multi-level wager games using a gaming device such as a video gaming terminal, portable gaming device or general purpose computer workstation. An embodiment will be described below in conjunction with a multi-player gaming system which facilitates a number of players to each play separate instances of multi-level games. The system includes a central gaming server communicable with each one of the plurality of gaming workstations. The server is operable to send data to each workstation whereby the workstation may display outcomes of play in multi-level games. Examples of such multi-level games include poker, video slots, and dice games such as Bunco.

Published PCT application WO 03/093921 A2, published Nov. 13, 2003, which is assigned to the assignee of the present invention, discloses a system whereby multiple distributed gaming workstations may engage in gaming activity via a central gaming server over a computer network such as the Internet. The entire contents of WO 03/093921 A2 are incorporated by reference herein. In one embodiment, the methods of this invention are implemented in a system of the type disclosed in the '921 published application.

The methods can also be implemented in a casino environment in which a plurality of gaming terminals, such as video slots terminals or video poker terminals, are connected to a central gaming server over a local area network.

Broadly speaking, in the method of this disclosure the player launches a gaming application or activates a "start" feature and a multi-level game is presented to the player. Typically, the player makes an initial wager, which is divided into N equal portions, where N is the number of levels in the game. N is typically an integer such as 2, 3, 4 or 5. They then play the first level of the game. For example, in a five draw poker game, they are dealt five cards, make a selection of held cards, and then receive replacement cards for the non-held cards. The method of this invention includes a step of determining the outcome of play at the first level, the first level having an outcome that is either a winning result or is not a winning result. This determination is typically done with reference to a first pay table which lists the winning hands and the associated payout. For example, determining the outcome of play amounts to determining whether the poker hand dealt to the player (in this instance, after the draw step) has a minimum poker hand ranking, such as a pair of Jacks. As another example, the play may consist of a turn of a slot machine and the determination is whether the reels of the slot machine have a winning combination of symbols in accordance with a slot machine pay table.

In the event that the play at the first level is not a winning result, rather than simply ending the game, as in the prior art for multi-level games, in the present invention the game is not over. Rather, the play continues. In particular, the method continues with the steps of (a) determining the result of play at the second level, the play at the second level having an outcome that is either a winning result or is not a winning result; and (b) providing the gaming device with data for displaying of the outcome of play at the first and the second level. The play at the second level may for example consist of revealing the cards in the hand that was dealt for the second level and determining whether the cards have a certain minimum poker hand ranking. Typically, this minimum poker hand (and associated pay table) ranking is different, and statistically less likely to occur, than the minimum poker hand ranking for the first hand, and may for example be a Royal Flush, Four of a Kind, or some other ranking for which the odds of the hand having such a ranking are low.

The idea here is that if the player does not have a winning hand at the first level, they still could win at the second level if the second level hand completed in this manner after a losing result at the first level has a Royal Flush, Four of a. Kind, or other hand meeting a minimum poker hand ranking in accordance with a second pay table. The gaming device is provided with the data for displaying not only the hand that resulted at the first (losing) level, but also the hand (outcome of play) at the second level so the player can see if they won at the second level in accordance with the pay table for the second hand completed in this manner.

The concept can be extended to play at third or fourth or higher levels. An example will be provided below of a four-level draw poker game.

Central Gaming Server Embodiment

Embodiments will be described with particular reference to a multi-level game for which play is facilitated by means of a central gaming server providing game results to a plurality of distributed gaming workstations over a computer network. Each distributed gaming workstation plays a separate instance of the multi-level game. In one possible example, the central gaming server facilitates play by distributed workstations via communication over the Internet. In another possible embodiment, the central gaming server facilitates play by distributed workstations connected to the gaming server via a local area network, for example workstations all located within a casino. In this latter embodiment, the gaming server could also be connected to the local area network.

Referring to FIG. 1, a gaming system for gaming in an Internet embodiment is indicated generally by reference numeral (1). The gaming system (1) includes a gaming server (2), and an on-line casino website (3) hosted on a casino web server (not shown). The online casino website (3) is accessible by a player (not shown) through a player gaming workstation (4) in the form of an Internet-enabled computer workstation having a display monitor (5) and an associated pointing device (5*a*) such as a mouse or, alternatively, a touchpad. In this embodiment, online casino website (3) is shown as being logically connected to two computer workstations (4). It will be appreciated by those skilled in the art that the online casino website (3) can be logically connected to any desired number of such computer workstations (4) simultaneously, which number is physically limited only by considerations of processing power and Internet access bandwidth.

The gaming server (2), the online casino web server (not shown) corresponding to the online casino website (3), and the computer workstations (4) are capable of communicating with each other by means of an open communication network that is, in this embodiment, the Internet. The Internet is represented in FIG. 1 as separate logical communication networks (6, 7, 8 and 9). The particular networking topology used and presence of intermediate networks or switching equipment is not important, and may for example make use of intervening communications network such as the public switched telephone network, cable networks, cellular wireless networks, WiFi, etc.

The gaming server (2) includes a corresponding database (14) with a credit account corresponding to each player who participates in a game offered by the online casino. In the illustrated embodiment, therefore, the database (14) has two associated, but separate, player credit accounts.

The gaming server (2) operates under control of a stored server program (not shown) capable of enabling the workstations (4) to each play a separate instance of a multi-level game. Each instance of the multi-level game played by each workstation (4) is treated as totally independent of the other instances of the game.

The online casino website (3) enables a player who desires to play a multi-level game, by means of one of the computer workstations (4), to place wagers on the game and to be presented with a display showing the outcome of play. Each participating player in an instance of the game is presented with graphical user interface ("GUI") on his respective computer workstation (4) by a separate stored program (not shown) in the workstation. The GUI presents to the player, on the display monitor (5), a display of the reels of a multi-level three-reel video slots game, multi-level poker game, or other game provided by the web site (3) and selected for play.

Each computer workstation (4) may take the form of a conventional personal computer operating under a Windows XP, ME, 2000 or other operating system, which is well known and commercially available from the Microsoft Corporation of Redmond, Wash., USA, or other operating system such as provided by Apple Computer or a Linux operating system. The gaming server (2) operates for example under the Windows NT operating system. The stored workstation program (not shown) and the corresponding stored server program will be referred to, for convenience, as a client process and a server process, respectively. The server process generates one or more random events that determine the outcome of play at each level of the multi-level game, such as determining the outcomes of spins of the reels in the various video slots games or the hands that are dealt and whether the hands have a minimum poker hand ranking in the case of a multi-level poker game. The client process of any particular computer workstation (4) obtains the result of the random events from the gaming server (2), along the communication network (9) and displays the outcome of the game on the display monitor (5) of the workstation in an intelligible manner, e.g., by causing the player's set of slots reels to spin and to come to rest at a position corresponding to the outcome. In order to play the game of multi-level games from any particular computer workstation (4), the client process (not shown) must first be downloaded to that computer workstation from the gaming server (2) or, alternatively from a separate web server (not shown), and then installed on the workstation.

In use, a player wishing to participate in the game of multiplayer slots uses a computer workstation (4) to access the online casino website (3) of his choice.

Example of Multi-Level Poker

FIGS. 2A-2E are a flow chart showing a sequence of operations performed by a client process executing in one of the distributed gaming workstations (4) and a server process executing in the central gaming server (2) in the system of FIG. 1 by which a multi-level game in the form of five card draw poker is played on the workstation in accordance with one representative embodiment. The flow charts will be further described in conjunction with FIGS. 3-7, which are screen shots showing screen displays presented on the graphical user interface of the workstation (4) of FIG. 1, showing a method of playing multi-level draw poker using the autocomplete feature of this disclosure.

Figure 2A:
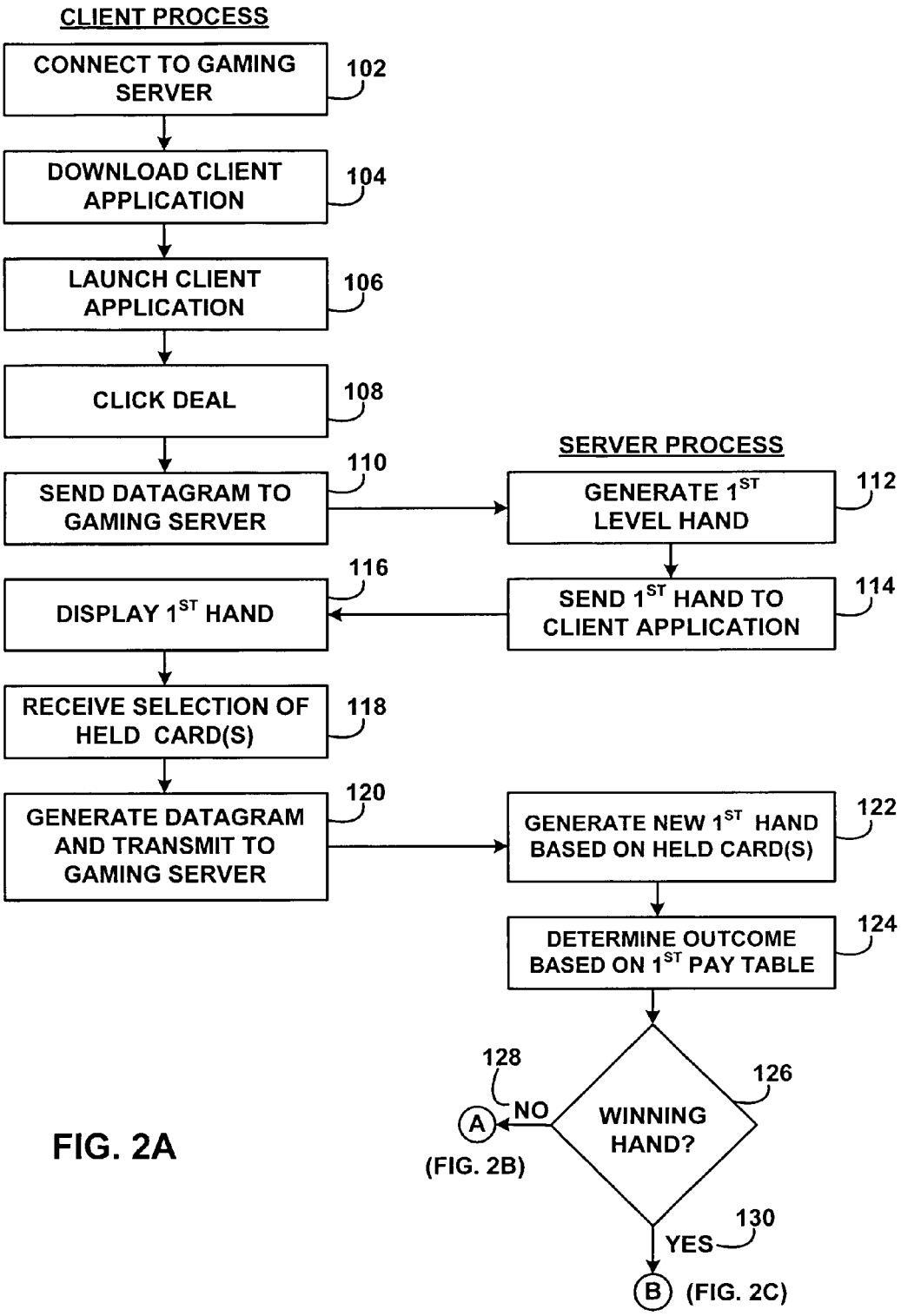
FIGS. 2A-2E are a flow chart showing a sequence of operations performed by a client process executing in one of the distributed gaming workstations and a server process executing in the central gaming server in the system of FIG. 1 by which a multi-level game is played on the workstation in accordance with one representative embodiment.
Figure 2B:
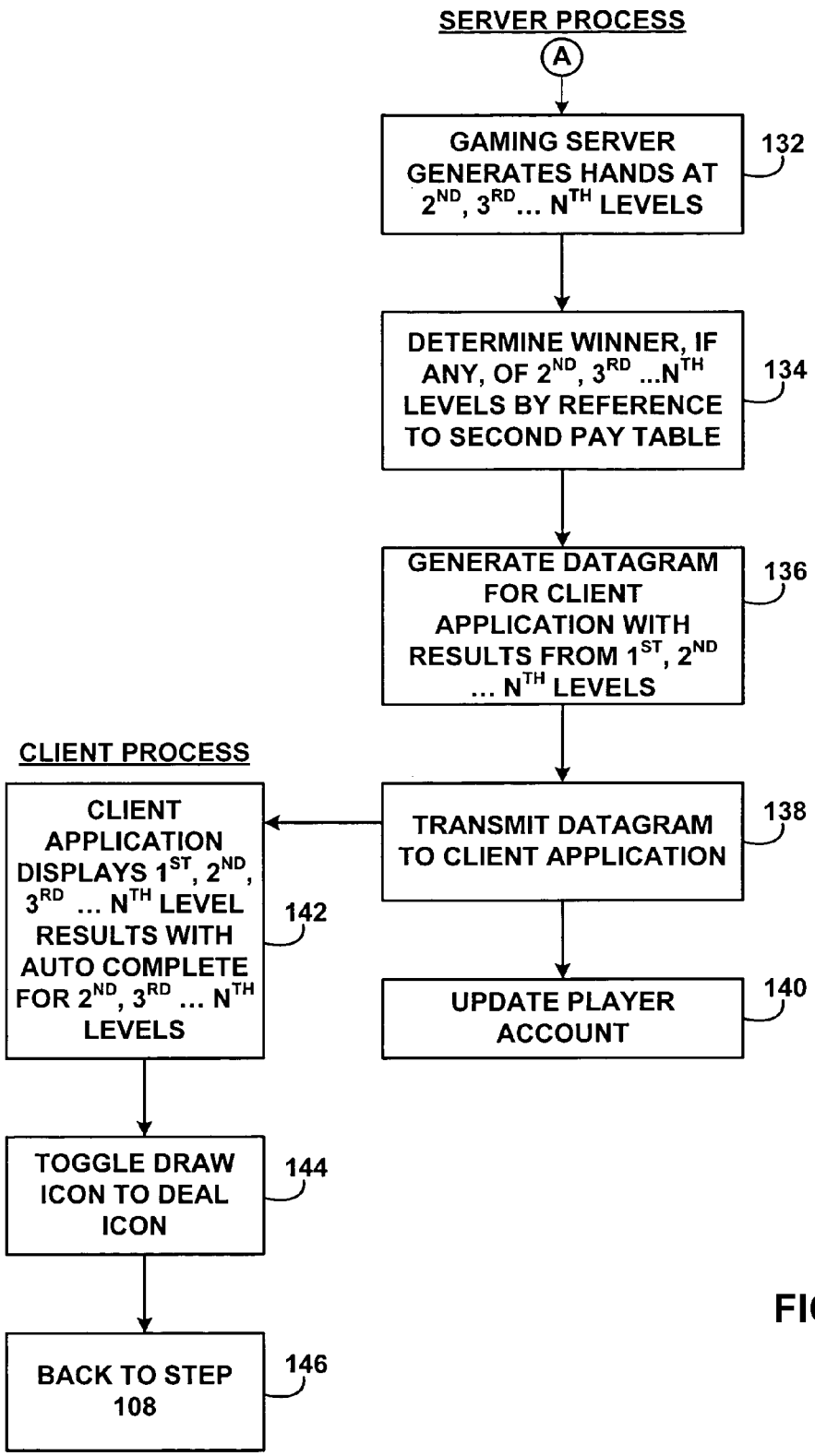
Figure 2C:
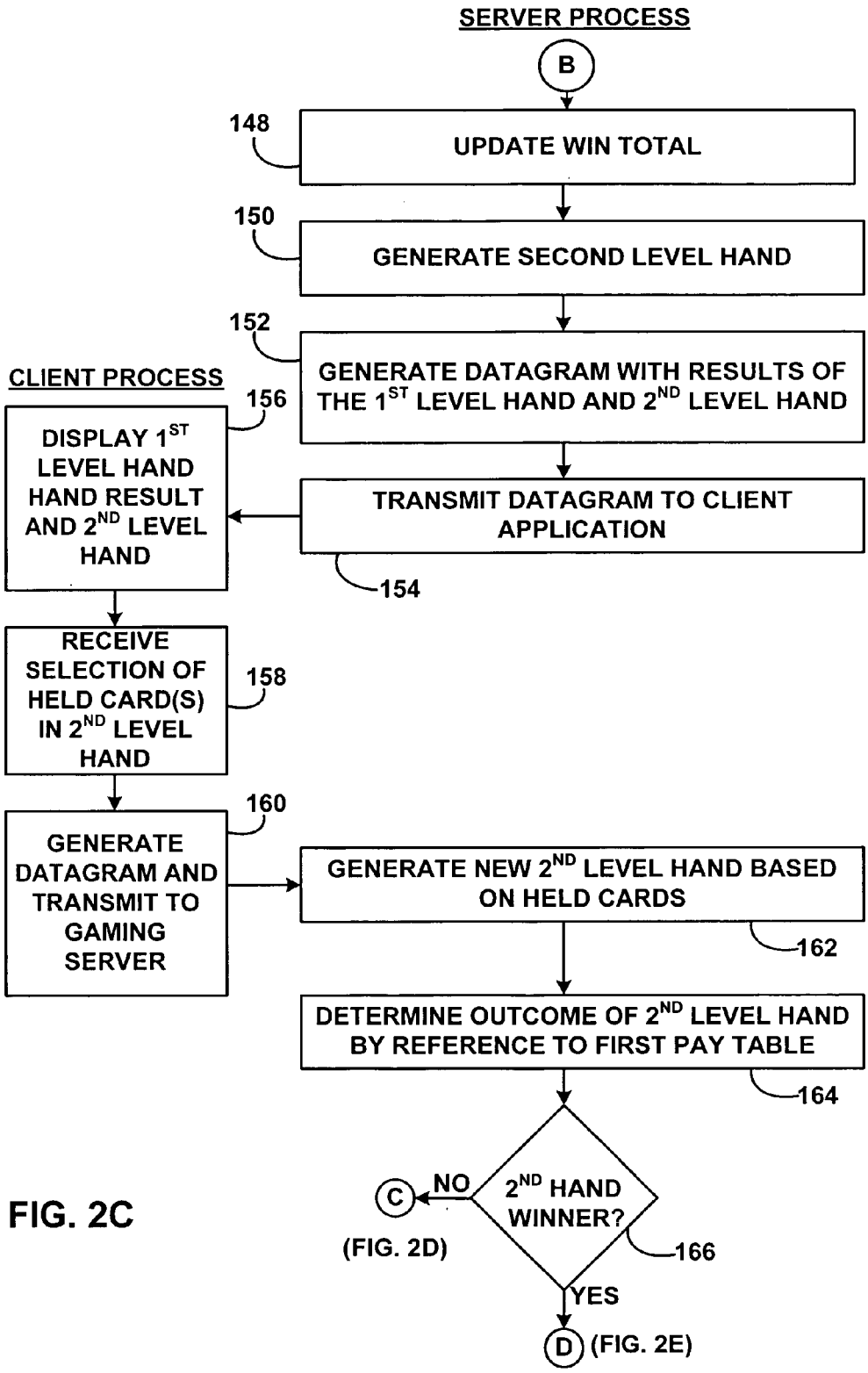

Referring now to FIG. 2A, at step (102), a workstation (4) launches their Internet browser and establishes a connection with the gaming server (2). At step (104), they download a client application which consists of an executable file which contains logic for presenting a multi-level game on the user interface (5) of the workstation (4). At step (106), the player launches the application. An example of the display created by the executable client application on the workstation is shown in FIG. 3.

Figure 3:
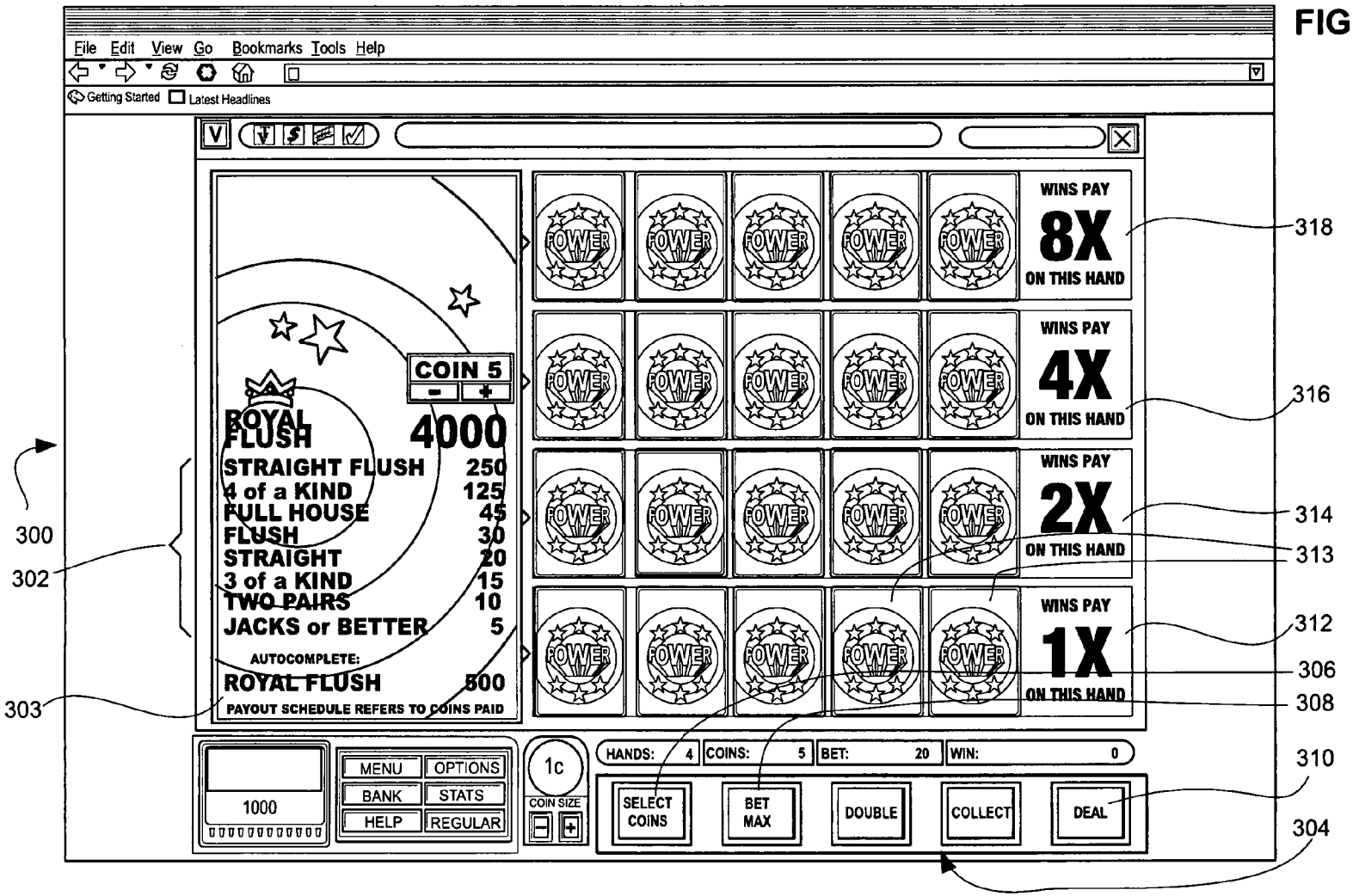
FIGS. 3-7 are screen shots showing screen displays presented on the graphical user interface of the workstation of FIG. 1, showing a method of playing multi-level draw poker using the autocomplete feature of this disclosure.
Figure 4:
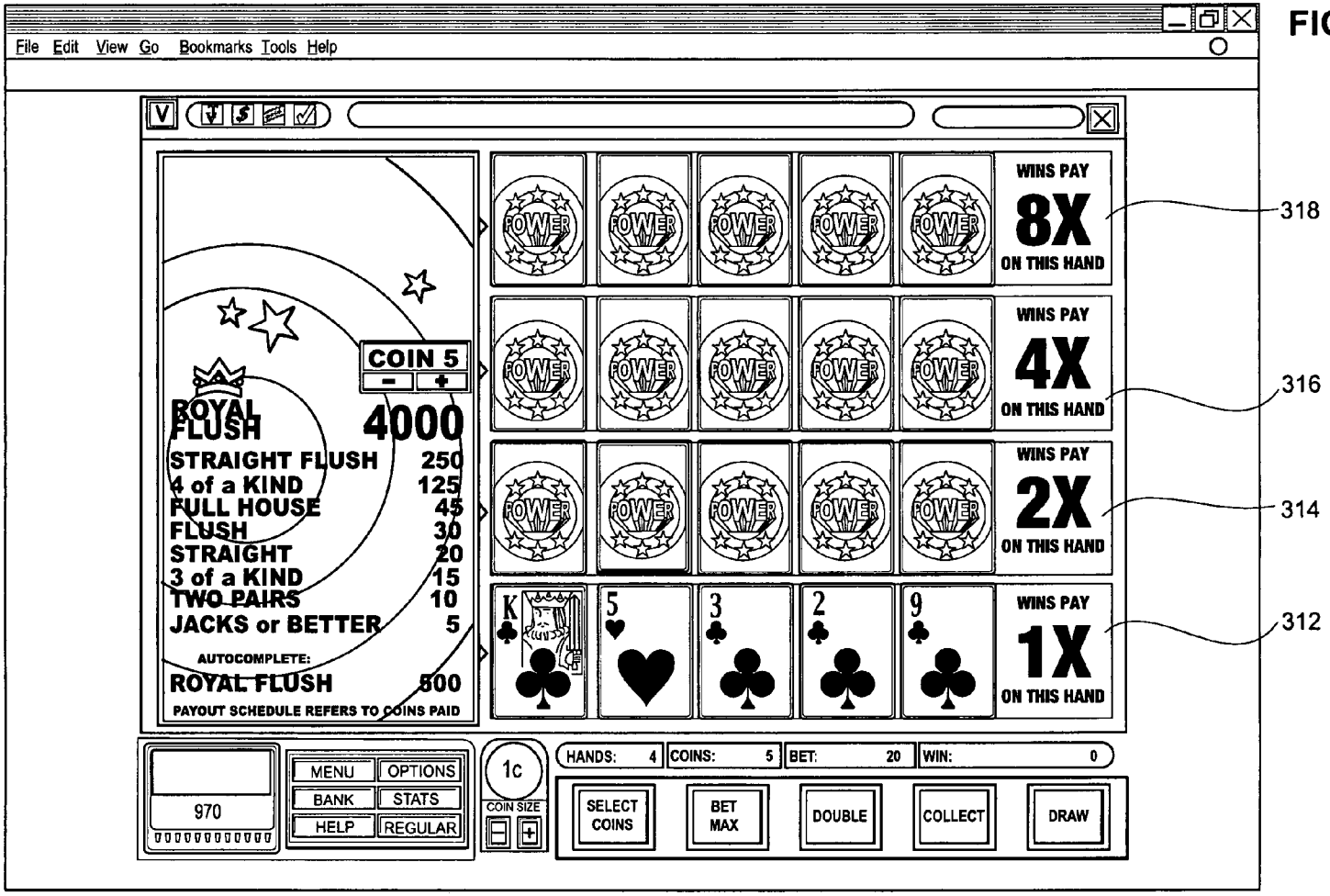
Figure 5:
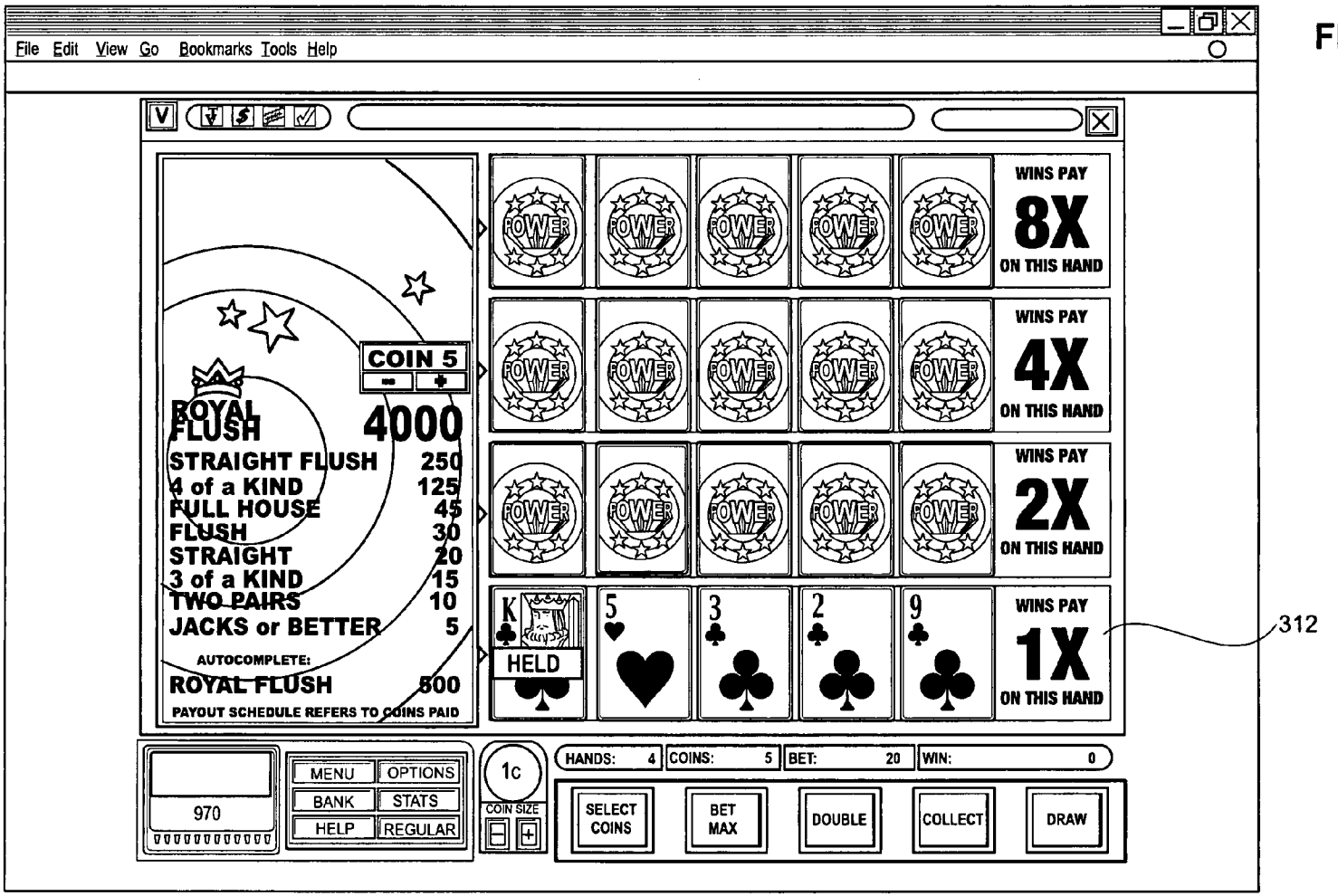
Figure 6:
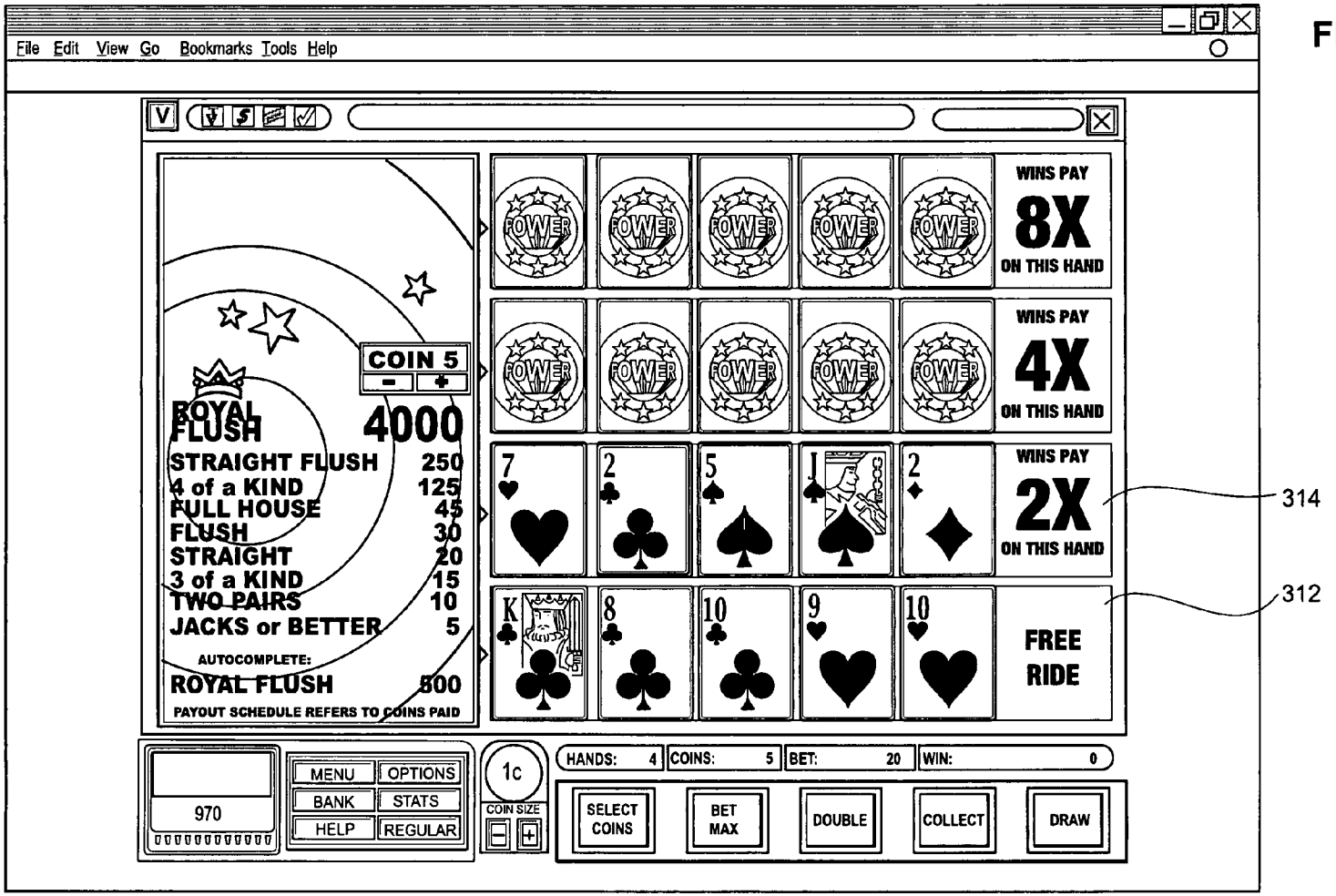
Figure 7:
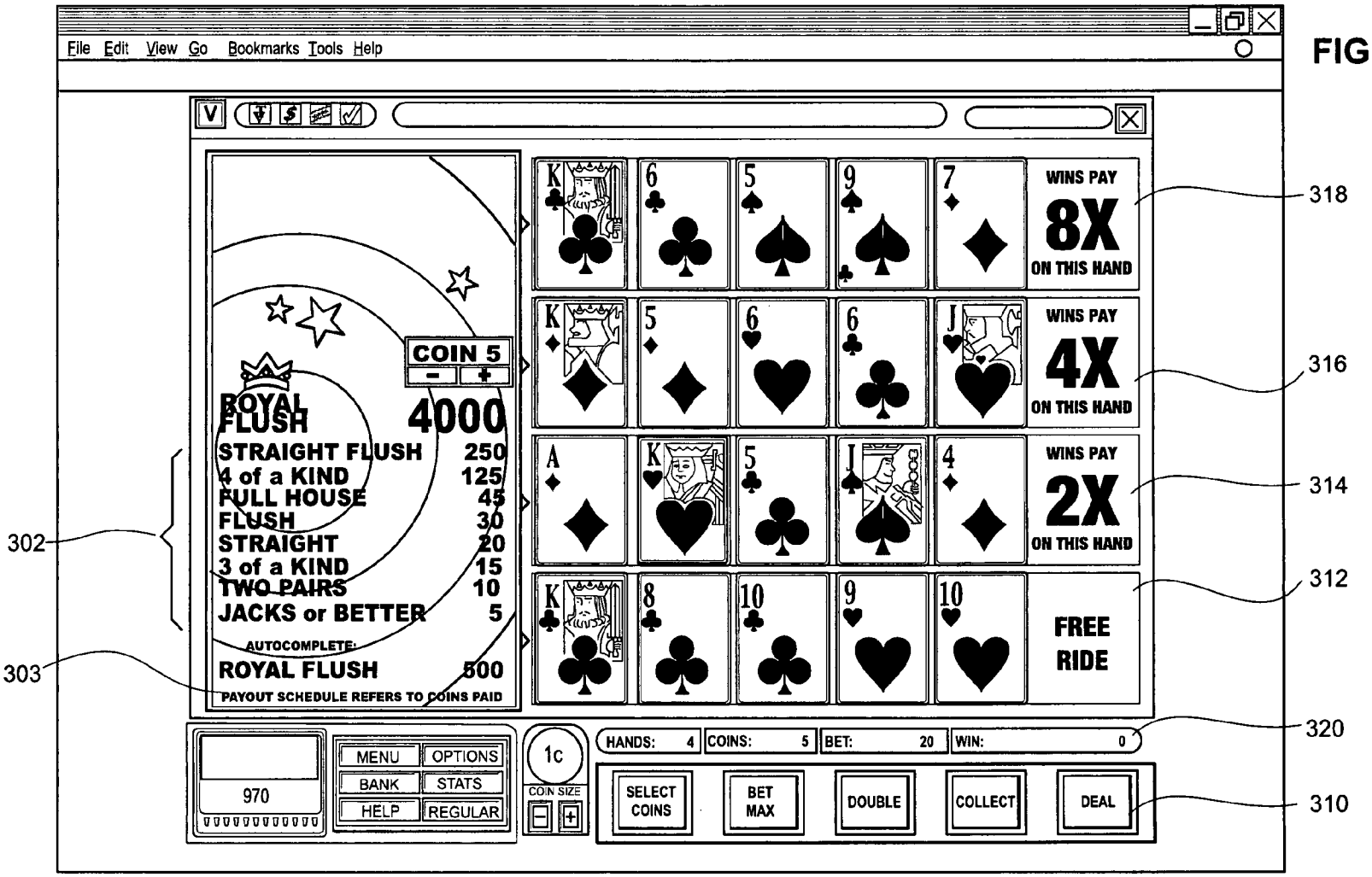

Referring to FIG. 3, the display (300) includes a first paytable (302) which shows poker hand rankings which are considered a winning result, and the payout for each poker hand ranking as a multiple of the amount wagered. The winning poker hands are Jacks or Better, Two Pairs, Three of a Kind, Straight, Flush, Full House, Four of a Kind, Straight Flush, and Royal Flush. The pay table (302) is applicable for play at the first level, the play at the second level if the player won at the first level, the play at the third level if the player won at the first and second levels, and the play at the fourth level if the player won at the first, second and third levels.

As noted above, if the player does not obtain a winning result at the first level, the game is not over and the cards in the second, third and fourth levels are revealed in an autocomplete mode, e.g., without further user involvement. For the play in this autocomplete mode, triggered whenever a player did not obtain a winning result at the first level, there is a second pay table established; This second pay table (303) is identified by the legend AUTOCOMPLETE, and includes in this version of the game a single hand which is required to produce a winning result—a Royal Flush, which is paid out at 500 to 1. Obviously, the proprietor or creator of the game could include other winning hands in the autocomplete pay table (303), depending on the flavor that they wish to provide to the game.

Typically, this minimum poker hand ranking in the second, autocomplete pay table (303) is different, and statistically less likely to occur, than the minimum poker hand ranking that is used in the pay table (302). The idea here is that if the player does not have a winning hand at the first level, they still could win at the second, third and fourth levels if the second level hand has a Royal Flush (or other minimum poker hand ranking in pay table (303)). However if the odds for winning in the autocomplete mode were as good as winning in the normal mode using pay table (302), then there is no risk of losing. So, the pay table (303) is constructed to provide a limited number of winning hands (even just one), and the odds of having a winning hand are less than the odds of winning a hand in the primary pay table (302).

The display (300) includes four levels of play in this example, levels (312), (314), (316) and (318). Each level consists of cards (313) shown face down. The player starts play by playing the hand at the first level (312). A winning hand of Jacks or better at the first level pays out at a multiple of one times the pay table (302). If the player wins at the first level, the player then advances to play at the second level (314), and a winning hand of Jacks or better at the second level pays out at a multiple of two times the pay table (302). If they win at the second level, they advance to the third level and if they have a winning hand of Jacks or better the third level, they win at a payout of four times the pay table (302). If they win at the third level, they advance to the fourth level and if they have a hand of Jacks or better at the fourth level they receive a payout at eight times the pay table (302). If they lose at any level, the higher levels are all played in the autocomplete mode and the player wins if any hand in the higher level completed in the autocomplete mode has a poker hand ranking of a Royal Flush in accordance with the pay table (303).

The display (300) include a wagering controls section (304), including an icon (306) that is used to select the number of coins or units to wager and a bet max icon (308) by which the user can wager a maximum number of coins or units. In the version of FIG. 3, there are four hands or levels, the player is wagering a total bet of 20 coins, and the 20 coins are divided equally among the four levels, five coins per level. The controls section (304) includes a deal icon (310).

To play the game, the use decides on a wager using the controls section (304) and then clicks the deal icon (310), shown as step (108) in FIG. 2A.

At step (110), a datagram is generated in the client process identifying the workstation (such as by workstation IP address, usename, or other means) and containing data indicating the game the user has selected (here Jacks or Better Power Poker) and the amount of the wager. The datagram is sent to the gaming server (2). At step (112), the gaming server (2) activates a state machine for generating an instance of play of the game of FIG. 3 for the workstation, and randomly selects five cards from a deck of virtual cards to generate the hand for the first level (312). At step (114), the gaming server (2) sends a datagram to the workstation (4) containing data identifying the cards randomly selected. At step (116), the datagram is received at the client process in the workstation (4) and the first hand is displayed. See FIG. 4. In this example, the first hand consists of the King of Clubs, Five of Hearts, Three of Clubs, Two of Clubs, and Nine of Clubs.

At step (118) of FIG. 2A, the player makes a selection of held cards using their mouse, such as by clicking on the card they wish to hold. See FIG. 5, where the player has elected to hold the King of Clubs. The selection is received by the client process. At step (120), the client process generates a datagram identifying the held card and transmits the card to the gaming server (2).

At step (122), the gaming server (2) generates a new first level hand based on the selection of the held King of Clubs and four new cards dealt from the same virtual deck of cards. Assume in this example that the new cards are the Eight of Clubs, Ten of Clubs, Nine of Hearts and Ten of Hearts. At step (124), the gaming server (2) determines whether a winning hand has occurred with reference to the first pay table (302). This would ordinarily be a losing hand since a pair of Jacks or better was not obtained. However, this version of the game includes a Free Ride feature whereby even in the event of a losing hand the player automatically advances to play at the second level.

At block (126), the server process determines whether the outcome was a winning result. If the outcome was not a winning result (branch 128) the process of FIG. 2B executes. In the present example, a Free Ride was randomly selected for the play at the first level so the processing advances to branch (130) and the process of FIG. 2C executes.

When the player does not produce a winning result at the first level, and no Free Ride was awarded, the autocomplete feature is triggered. The processing is shown as steps (132-146) of FIG. 2B. The first step (132) is that the gaming server (2) generates hands at the second, third, . . . Nth levels, here N=4 for a four level game. Each hand at each of the second, third, . . . Nth levels is dealt from a separate virtual deck of cards. At step (134), the gaming server (2) determines whether a winning hand occurred in any of the second, third, . . . Nth levels by reference to the second pay table (303) (FIG. 3). At step (136), the server process generates a datagram for the client application which the results of the first hand (the King of Clubs, Eight of Clubs, Ten of Clubs, Nine of Hearts and Ten of Hearts) and the $2^{nd}$ . . . Nth hands automatically generated at step (132). At step (138) the datagram is transmitted to the client application. At step (140), the gaming server (2) updates the player's account in the database (14), in this instance debiting the player's credit account with the total amount wagered, in this example 20 coins or units.

At step 142, the client process displays the hands resulting from play at the $1^{st}$, . . . Nth levels. The cards at the first level are presented on the workstation display first (the King of Clubs, Eight of Clubs, Ten of Clubs, Nine of Hearts and Ten of Hearts), and then the cards in the second level, third level and fourth level are turned over and displayed in an autocomplete mode. Any winning result for the autocomplete levels would be displayed on the display. In this example, no winning result was achieved at any level. At step (144), the deal icon is toggled from DRAW to DEAL. Then, the processing goes back to step (108) and the player can play another instance of the game as indicated at step (146).

Suppose the player did not have a winning hand at the first level but was awarded a Free Ride. This is a winning result at step (126), and so the processing reverts to the YES branch (130) and then the process of FIG. 2C executes.

At step (148), the server process determines the win for play in the first level in accordance with the pay table (302). At step (150), the server process generates a second level hand, selecting five cards at random from a second virtual deck of cards. At step (152), the server process generates a datagram with the results of the first level hand (the King of Clubs, Eight of Clubs, Ten of Clubs, Nine of Hearts and Ten of Hearts) and the five cards selected at random in step (150). At step (154), the datagram is transmitted to the client application executing on the workstation (4).

At step (156), the client process receives the datagram and displays the first level hand result and the second level hand. See FIG. 6. The first level hand (312) can be shown in phantom or dimmed to indicate no winning result. The first level hand (312) is shown with the Free Ride icon, explaining to the player why they lost at the first level but are still dealt a hand at the second level (314).

At step (158), the player makes a selection of one or more cards to hold at the second level (314) using the mouse, such as by clicking on one or more cards in the second level (314). The selection of cards is received by the client application. Suppose in this example the player selected the Jack of Spades as the card to hold.

At step (160), the client application generates a datagram identifying the Jack of Spades as the held card in the second level hand and transmits the datagram to the gaming server (2).

At step (162), the gaming server (2) generates a new second level hand based on the held cards, and adds randomly selected cards from the same virtual deck of cards to complete the hand. At step (164), the gaming server again determines whether the outcome of the second level hand is a winning result by reference with the primary pay table (302).

Figure 2D:
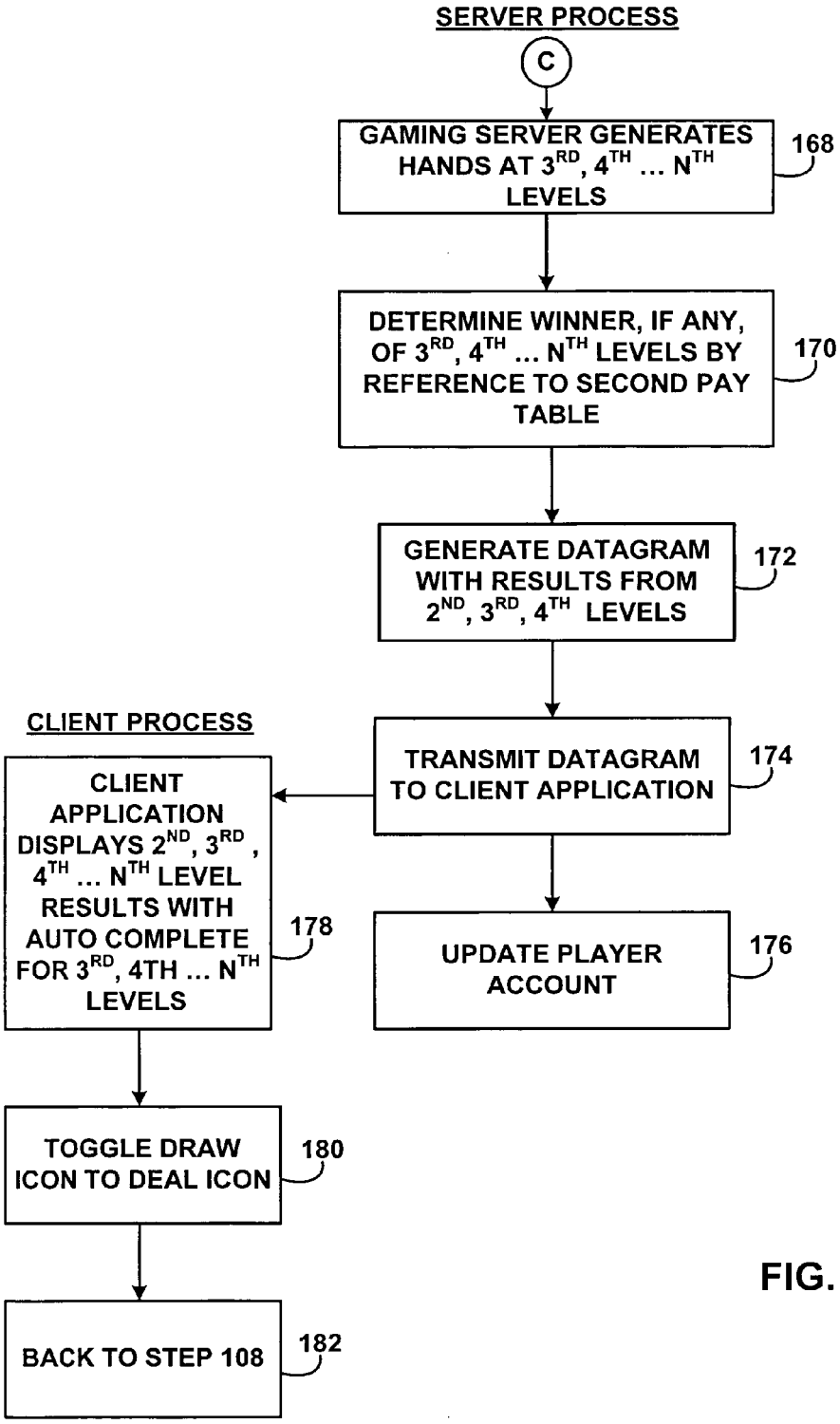

If the second hand is not a winning result, the processing branches at step (166) to the processing of FIG. 2D. At step 158, the gaming server (2) generates hands at the third, fourth . . . Nth levels (N=4 in this example). At step (170), the gaming server determines whether any of the hands generated at step (168) are a winning result by reference to the autocomplete pay table (303). At step (172), the gaming server (2) then generates a datagram with the results from the second, third and fourth levels and at step (174) transmits the datagram to the client application. At step (176) the player's credit account is updated by the gaming server (12).

The datagram transmitted at step (174) is received by the client application at step (178) and the client application displays the second, third, and fourth level hands on the display of the workstation. See FIG. 7. In the second level hand, the player selected to hold the Jack of Spades, but was not dealt any other Jacks. So, the player did not win at the second level (314). However, they still got to play the third and fourth levels (316) and (318). The hands generated by the gaming server for the third and fourth levels are displayed in an autocomplete mode. Unfortunately for the player, neither the hand at the third or fourth level was a Royal Flush, and so the player did not have a winning result at the third or fourth level either in accordance with the pay table (303). The Win field (320) is updated to show that the player had a total win of 0 for play at the four levels.

At step (180) the DRAW icon is toggled to DEAL (310). At step (182), the processing goes back to step (108) (FIG. 2A) and the player can play a new round of the game.

If, at step (166), the second hand play produces a winning result in accordance with the primary pay table (302), the player advances to play at the third level. The processing proceeds to that of FIG. 2E.

At step (184), the server updates the player's total win amount and at step (186) generates a hand for the third level by randomly selecting five cards from a virtual deck of cards. At step (188), the server generates a datagram with the results of play of the $2^{nd}$ level, plus the five cards selected at random for the third level hand. At step (190), the gaming server transmits the datagram to the client application.

At step (192), the client application displays on the workstation the second level hand result, and the five cards selected for the third level. The player then makes a selection of one or more cards to hold at the third level and the selection is received by the client application at step (194). At step (196), the client application generates a datagram containing the selection of cards and transmits the datagram to the gaming server (2).

At step (198), the server process generates a new third-level hand using the selection of any held cards plus randomly selected additional cards to replace the un-held cards. At step (200), the server process determines whether the outcome of play at the third level is a winning result in accordance with the primary pay table (302). If no winning result was achieved at the third level, the process of FIG. 2D repeats. Basically, a hand for the fourth level is generated, and a determination is made of whether the fourth level hand is a winning hand in accordance with the autocomplete pay table (303). The server transmits a datagram to the client application containing the result of the third level hand and the fourth level hand and the player is presented with the third level hand and the fourth level hand, with the fourth level hand completed in an autocomplete mode. The player's total winnings for the first, second, and fourth level hands (if a winning result was obtained at this level) are tallied, and a deduction is made of the amount wagered. The player's account is credited or debited by the net amount and the player is able to click on the DEAL icon and play another round.

Figure 2E:
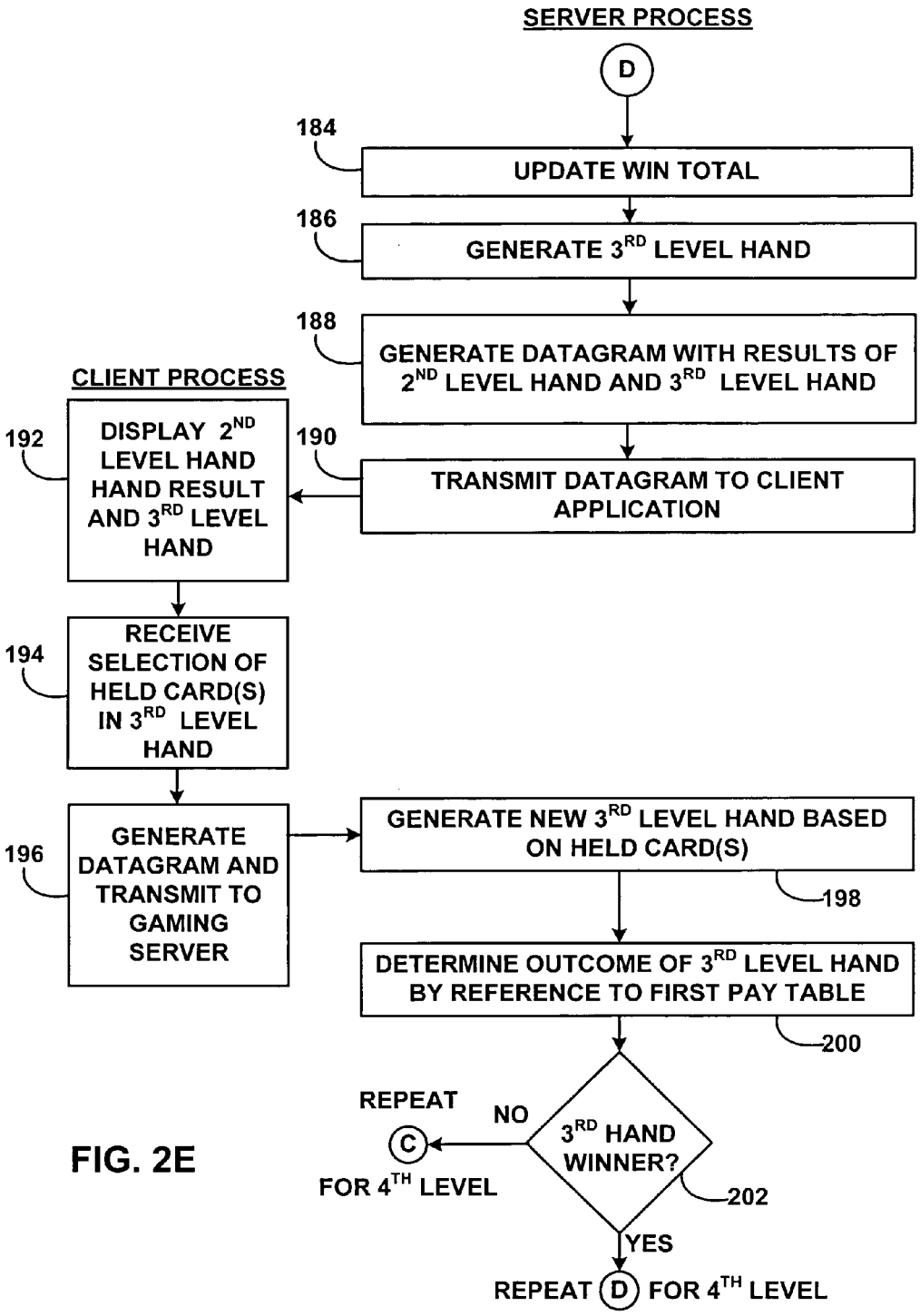

Suppose that in the third level hand a winning result was achieved (step (202) of FIG. 2E). The process of FIG. 2E repeats for the fourth level hand. This is the highest level in the example of the game of FIG. 3. If the player does not achieve a winning result in the fourth level hand using the primary pay table (302), there is no autocomplete for higher level hands since there are no higher levels. The player's total winnings from the first, second and third level hands are tallied and a deduction is made for the amount wagered. The player's account is updated. The player is presented with the results of play at the first through fourth levels and can play another game by clicking on the DEAL icon (310). If the player wins at the fourth level in accordance with the primary pay table (302), the player's total winnings from the first, second, third and fourth level hands are tallied and a deduction is made for the amount wagered. The player's account is updated. The player is presented with the results of play at the first, second, third and fourth levels. They can play another game by clicking on the DEAL icon (3 10).

It will be understood that the example of multi-level wager game of poker described herein can be extended to other games such as video slots. In a video slots game, the player is presented with N levels of slot machine reels. They play the first level. If a winning combination is achieved in accordance with a primary pay table, they proceed to play the reel at the second level. If a winning result is not achieved at the first level, the second, third . . . Nth level slot machine reels spin anyway and a player wins at the second, third . . . Nth levels in an autocomplete mode if a particular combination is achieved at these levels in accordance with a second pay table. For example, this second pay table could be one in which only certain results are considered winning results, ones in which there is a statistically less likelihood of obtaining than a winning result in the primary pay table. For example, the primary pay table could recognize 20 different combinations, such as BAR BAR CHERRY, BAR BAR LEMON, any BAR 7, LEMON LEMON LEMON, etc. However, in the second pay table, only BAR BAR BAR is a winning result. The idea here is that although the player did not win a winning result in the play at the first level, they still get a shot at winning at the second, third, . . . Nth levels if the slot machine any one of these levels one happens to return BAR BAR BAR.

The concepts of the autocomplete being triggered if a player advances to a higher level and then loses at that level, as explained above in the context of FIGS. 2A-2E for a poker game, are applicable to the video slots example as well.

The concepts are of course also applicable to other wager games capable of being played at multiple levels, such as other wager games using cards, as well as dice games.

While a number of exemplary aspects and embodiments have been discussed above, those of skill in the art will recognize certain modifications, permutations, additions and sub-combinations thereof as being present in the disclosure. For example, the particular details of the design of the user interface on the workstation are not particularly important. As another example, the architecture of gaming server system (such as the possible use of two or more servers to function as a gaming server for multiple workstations) is not particularly important. It is therefore intended that the following appended claims and claims hereafter introduced are interpreted to include all such modifications, permutations, additions and sub-combinations as are within their true spirit and scope.

What is claimed is:

1. A method of playing a wager game on a gaming device, the method comprising:

determining a plurality of levels and a wager for the wager game using the gaming device, wherein the plurality of levels comprise at least a first level and a second level;

determining that an autocomplete feature is not triggered prior to playing the first level of the wager game using the gaming device;

playing each level of the plurality of levels of the wager game using the gaming device, the first level of the wager game being played first, wherein playing a level of the wager game comprises the gaming device:

determining a portion of the wager for the level;

selecting a pay table for the level from at least a first pay table and a second pay table, wherein the first pay table is selectable when the autocomplete feature is not triggered, wherein the second pay table is selected while the autocomplete feature is triggered, wherein each of the first pay table and the second pay table comprises a list of one or more winning results, and wherein a statistical probability of a winning result in an outcome of play of the wager game using the second pay table is less than a statistical probability of a winning result in an outcome of play of the wager game using the first pay table;

determining an outcome of play for the level that is either a winning result or a losing result in accordance with the selected pay table associated with the wager game and the portion of the wager, wherein user involvement in the outcome of play is inhibited for each level that the autocomplete feature is triggered; and in the event that the outcome of play for the level is a losing result, triggering the autocomplete feature for all subsequent levels of play.

2. The method of claim 1, wherein the wager game comprises poker, and wherein an outcome that is a winning result for the second level comprises a Royal Flush.

3. The method of claim 1, wherein the gaming device comprises a general purpose computer, and wherein facilitating play comprises generating and sending one or more datagrams to the general purpose computer containing data indicating the outcome of play of the first level and the second level.

4. The method of claim 1, wherein the plurality of levels includes a third level.

5. The method of claim 4, wherein the plurality of levels further includes a fourth level.

6. A method of playing a wager game, the method performed by a gaming device, wherein the gaming device includes a computer programmed to perform at least the functions of:

determining a plurality of levels and a wager for the wager game using the gaming device, wherein the plurality of levels comprise at least a first level and a second level;

determining that an autocomplete feature is not triggered prior to playing the first level of the wager game using the gaming device;

determining a portion of the wager for the first level using the gaming device;

selecting a first pay table for determining an outcome of play at the first level using the gaming device;

determining the outcome of play at the first level using the gaming device, the first level having an outcome that is either a winning result or a losing result in accordance with the first pay table associated with the wager game at the first level and the portion of the wager for the first level;

displaying the outcome of play at the first level using the gaming device;

in the event the outcome of play at the first level is a losing result, triggering the autocomplete feature for all levels of the plurality of levels subsequent to the first level using the gaming device, wherein user involvement in the outcome of play is inhibited for each level that the autocomplete feature is triggered;

after determining an outcome for play for the first level, determining a portion of the wager for the second level using the gaming device;

selecting a second pay table for determining an outcome of play at the second level using the gaming device, wherein the second pay table differs from the first pay table, wherein a pay table with a statistical probability of producing a winning result less than a statistical probability of the first pay table producing a winning result is selected as the second pay table when the autocomplete feature is triggered for the second level;

determining the outcome of play at the second level using the gaming device, the second level having an outcome that is either a winning result or a losing result in accordance with the second pay table and the portion of the wager for the second level; and displaying the outcome of play at the second level using the gaming device.

7. The method of claim 6, wherein the plurality of levels includes a third level, and wherein, in the event the play at the first level produces a winning result the player advances to play at the second level, and in the event the outcome of play at the second level does not produce a winning result, the method further comprising:

triggering the autocomplete feature for all levels of the plurality of levels subsequent to the first level, wherein user involvement in the outcome of play is inhibited for each level that the autocomplete feature is triggered;

after determining an outcome for play for the second level, determining a portion of the wager for the third level;

after the autocomplete feature is triggered for the third level, selecting the pay table with the statistical probability of producing a winning result less than the statistical probability of the first pay table producing a winning result as a third pay table; and determining an outcome of play at the third level using the gaming device, the third level having an outcome that is either a winning result or a losing result in accordance with the third pay table and the portion of the wager for the third level.

8. The method of claim 6, wherein the wager game comprises poker and wherein an outcome that is a winning result at the second level comprises a Royal Flush.

9. A non-transitory machine readable storage medium comprising a set of instructions for execution by a gaming workstation, the gaming workstation placed in communication with a gaming server over a network, the instructions comprising:

instructions for determining a plurality of levels and a wager for a wager game, wherein the plurality of levels comprise at least a first level and a second level;

instructions for determining that an autocomplete feature is not triggered prior to playing the first level of the wager game; and instructions for playing each level of the plurality of levels of the wager game, the first level of the wager game being played first, wherein playing a level of the wager game comprises:

determining a portion of the wager for the level;

selecting a pay table for the level from at least a first pay table and a second pay table, wherein the first pay table is selectable when the autocomplete feature is not triggered, wherein the second pay table is selected while the autocomplete feature is triggered, wherein each of the first pay table and the second pay table comprises a list of one or more winning results, and wherein a statistical probability of a winning result in an outcome of play of the wager game using the second pay table is less than a statistical probability of a winning result in an outcome of play of the wager game using the first pay table;

determining an outcome of play for the level that is either a winning result or a losing result in accordance with the selected pay table associated with the wager game and the portion of the wager, wherein user involvement in the outcome of play is inhibited for each level that the autocomplete feature is triggered; and in the event that the outcome of play for the level is a losing result, triggering the autocomplete feature for all subsequent levels of play.

10. The non-transitory machine readable medium of claim 9, wherein the gaming workstation comprises a general purpose computer.

11. The non-transitory machine readable medium of claim 10, wherein the gaming workstation comprises a video gaming terminal.

12. The non-transitory machine readable medium of claim 9, wherein the gaming workstation is installed in a casino.

13. The non-transitory machine readable medium of claim 9, wherein the outcome that is a winning result for play that is automatically completed at the second level comprises a Royal Flush.

14. A central gaming system, comprising:

one or more processing units and machine readable storage media comprising a set of instructions, said instructions including instructions for providing the central gaming system to perform the functions of, for each of the distributed gaming workstations:

determining a plurality of levels and a wager for a wager game, wherein the plurality of levels comprise at least a first level and a second level;

determining that an autocomplete feature is not triggered for the gaming device prior to playing the first level of the wager game;

determining a portion of the wager for the first level;

determining an outcome of play at the first level, the outcome being either a winning result or a losing result in accordance with a first pay table and the portion of the wager for the first level;

in the event that the outcome of play at the first level is a losing result, triggering the autocomplete feature for all subsequent levels of play of the wager game;

after determining the outcome of the first level, determining a portion of the wager for the second level;

selecting a second pay table for determining an outcome of play at the second level, wherein the second pay table differs from the first pay table, wherein a pay table with a statistical probability of producing a winning result less than a statistical probability of the first pay table producing a winning result is selected as the second pay table when the autocomplete feature is triggered for the second level;

determining the outcome of play at the second level, the second level having an outcome that is either a winning result or a losing result in accordance with the second pay table and the portion of the wager for the second level;

generating one or more datagrams containing data comprising the outcome of play at the first level and the outcome of play at the second level; and transmitting the one or more datagrams.

15. The central gaming system of claim 14, wherein the central gaming system is configured to communicate with a plurality of distributed gaming workstations via the Internet.

16. The central gaming system of claim 15, wherein the plurality of distributed gaming systems comprise one or more video gaming terminals.

17. The central gaming system of claim 14, wherein an outcome that is a winning result at the second level comprises a Royal Flush.

18. The central gaming system of claim 15, wherein the plurality of distributed gaming workstations are distributed in a gaming casino.

19. The method of claim 1, wherein determining a portion of the wager for the level comprises determining an equal portion of the wager for each level of the plurality of levels.

20. The method of claim 1, wherein the second pay table comprises a list of one winning result.

* * * * *